US011729889B2

(12) United States Patent
Butler et al.

(10) Patent No.: US 11,729,889 B2
(45) Date of Patent: Aug. 15, 2023

(54) LIGHTING APPARATUS HAVING ULTRA-LOW MODE

(71) Applicant: MILWAUKEE ELECTRIC TOOL CORPORATION, Brookfield, WI (US)

(72) Inventors: Daniel P. Butler, Wauwatosa, WI (US); Ryan A. Spiering, Milwaukee, WI (US); Zachary Self, Nashotah, WI (US); Justina M. Rinzel, Pleasant Prairie, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 17/577,939

(22) Filed: Jan. 18, 2022

(65) Prior Publication Data

US 2022/0232687 A1 Jul. 21, 2022

Related U.S. Application Data

(60) Provisional application No. 63/138,563, filed on Jan. 18, 2021.

(51) Int. Cl.

| | |
|---|---|
| ***H05B 47/17*** | (2020.01) |
| ***H05B 47/165*** | (2020.01) |
| ***F21L 4/00*** | (2006.01) |
| ***F21Y 115/10*** | (2016.01) |

(52) U.S. Cl.

CPC ..... *H05B 47/17* (2020.01); *F21L 4/005* (2013.01); *H05B 47/165* (2020.01); *F21Y 2115/10* (2016.08)

(58) Field of Classification Search

CPC ..... H05B 47/17; H05B 47/165; H05B 45/10; F21L 4/005; F21Y 2115/10

See application file for complete search history.

(56) References Cited

U.S. PATENT DOCUMENTS

| | | | |
|---|---|---|---|
| 5,138,538 | A | 8/1992 | Sperling |
| 6,017,140 | A | 1/2000 | Chou |
| 6,249,089 | B1 | 6/2001 | Bruwer |

(Continued)

FOREIGN PATENT DOCUMENTS

| | | | |
|---|---|---|---|
| CN | 201059428 | Y | 5/2008 |
| CN | 201190905 | Y | 2/2009 |

(Continued)

OTHER PUBLICATIONS

International Search Report and Written Opinion for Application No. PCT/US2022/012763 dated May 4, 2022 (10 pages).

*Primary Examiner* — Daniel D Chang

(74) *Attorney, Agent, or Firm* — Michael Best & Friedrich LLP

(57) ABSTRACT

A lighting apparatus includes a light source operable to emit different levels of brightness, and a user interface configured to be selectively actuated by a user to turn the light source off and on. When the light source is off and the user interface is actuated for a first amount of time, the light source turns on in a first mode in which the light source emits a first level of brightness. When the light source is off and the user interface is actuated for a second amount of time that is different from the first amount of time, the light source turns on in an ultra-low mode in which the light source emits a second level of brightness.

11 Claims, 3 Drawing Sheets

(56) References Cited

U.S. PATENT DOCUMENTS

| | | | |
|---|---|---|---|
| 6,585,391 | B1 | 7/2003 | Koch et al. |
| 6,621,225 | B2 | 9/2003 | Bruwer |
| 6,642,667 | B2 | 11/2003 | Avis |
| 6,650,066 | B2 | 11/2003 | Bruwer |
| 6,942,357 | B2 | 9/2005 | Parsons et al. |
| 6,952,084 | B2 | 10/2005 | Bruwer |
| 6,984,900 | B1 | 1/2006 | Bruwer |
| 7,084,526 | B2 | 8/2006 | Bruwer |
| 7,084,531 | B2 | 8/2006 | Bruwer |
| 7,122,973 | B1 | 10/2006 | Ivers |
| 7,125,140 | B2 | 10/2006 | Koch et al. |
| 7,186,002 | B2 | 3/2007 | Matthews et al. |
| 7,220,016 | B2 | 5/2007 | Matthews et al. |
| 7,261,433 | B2 | 8/2007 | Parsons et al. |
| 7,265,494 | B2 | 9/2007 | Bruwer |
| 7,281,815 | B1 | 10/2007 | Gustafson et al. |
| 7,291,940 | B2 | 11/2007 | Bruwer |
| 7,293,893 | B2 | 11/2007 | Kim |
| 7,329,970 | B2 | 2/2008 | Bruwer |
| 7,336,037 | B2 | 2/2008 | Bruwer |
| 7,344,270 | B2 | 3/2008 | Kim |
| 7,434,955 | B2 | 10/2008 | Vickers et al. |
| 7,443,101 | B2 | 10/2008 | Bruwer |
| 7,498,749 | B2 | 3/2009 | Bruwer |
| 7,527,388 | B2 | 5/2009 | Kim |
| 7,528,508 | B2 | 5/2009 | Bruwer |
| 7,540,625 | B2 | 6/2009 | Matthews et al. |
| 7,549,766 | B2 | 6/2009 | Sharrah et al. |
| 7,566,149 | B2 | 7/2009 | Koch et al. |
| 7,604,371 | B2 | 10/2009 | Bushee et al. |
| 7,722,209 | B2 | 5/2010 | Matthews et al. |
| 7,771,077 | B2 | 8/2010 | Miller |
| 7,772,781 | B2 | 8/2010 | Bruwer |
| 7,781,980 | B2 | 8/2010 | Bruwer |
| 7,802,898 | B1 | 9/2010 | Gregory et al. |
| D625,861 | S | 10/2010 | Bertken |
| 7,845,820 | B2 | 12/2010 | Bertken |
| 7,850,330 | B2 | 12/2010 | Spartano et al. |
| 7,866,841 | B2 | 1/2011 | Bushee et al. |
| 7,905,624 | B2 | 3/2011 | Bushee et al. |
| 7,959,317 | B2 | 6/2011 | Spartano et al. |
| 7,994,726 | B2 | 8/2011 | Bruwer |
| 8,035,623 | B2 | 10/2011 | Bruwer |
| 8,096,674 | B2 | 1/2012 | Matthews et al. |
| 8,113,682 | B2 | 2/2012 | Bertken |
| 8,169,165 | B2 | 5/2012 | West |
| 8,186,846 | B2 | 5/2012 | Bertken |
| 8,210,710 | B2 | 7/2012 | Koch et al. |
| RE43,606 | E | 8/2012 | Bruwer |
| 8,240,874 | B2 | 8/2012 | Koch et al. |
| 8,288,952 | B2 | 10/2012 | Bruwer |
| 8,308,316 | B2 | 11/2012 | Sparrow |
| 8,356,910 | B2 | 1/2013 | Messinger et al. |
| 8,376,574 | B2 | 2/2013 | Spartano et al. |
| 8,395,066 | B2 | 3/2013 | Koch et al. |
| 8,469,540 | B1 | 6/2013 | Gregory et al. |
| 8,507,819 | B2 | 8/2013 | Steinicke et al. |
| 8,529,086 | B2 | 9/2013 | Skrivan et al. |
| 8,529,087 | B2 | 9/2013 | Bertken |
| 8,531,120 | B2 | 9/2013 | Bruwer |
| 8,760,085 | B2 | 6/2014 | West |
| 8,823,273 | B2 | 9/2014 | Bruwer |
| 8,827,484 | B2 | 9/2014 | Messinger et al. |
| 8,960,949 | B2 | 2/2015 | Koch et al. |
| 9,035,576 | B2 | 5/2015 | West |
| 9,060,407 | B2 | 6/2015 | West |
| 9,074,739 | B2 | 7/2015 | Deighton et al. |
| 9,161,425 | B2 | 10/2015 | Burayez et al. |
| 9,226,376 | B2 | 12/2015 | Bruwer |
| 9,408,262 | B2 | 8/2016 | West |
| 9,435,523 | B2 | 9/2016 | West |
| 9,540,064 | B2 | 1/2017 | Sparrow |
| 9,588,628 | B2 | 3/2017 | Bruwer |
| 9,645,692 | B2 | 5/2017 | Bruwer |
| 9,719,669 | B2 | 8/2017 | Koch et al. |
| 9,759,414 | B2 | 9/2017 | West |
| 9,810,412 | B2 | 11/2017 | West |
| 9,977,607 | B2 | 5/2018 | West |
| 10,018,342 | B2 | 7/2018 | Koch et al. |
| 10,208,936 | B2 | 2/2019 | West |
| 10,260,689 | B2 | 4/2019 | Qiu |
| 10,302,284 | B2 | 5/2019 | Ammer |
| 10,344,951 | B2 | 7/2019 | Aoki et al. |
| 10,412,805 | B1 | 9/2019 | Schwarz et al. |
| 10,458,641 | B2 | 10/2019 | Proeber |
| 10,663,146 | B2 | 5/2020 | Stevenson et al. |
| 2005/0122710 | A1* | 6/2005 | Kim ..... H05B 45/14 362/157 |
| 2005/0237734 | A1 | 10/2005 | Krieger |
| 2006/0064144 | A1 | 3/2006 | Chen et al. |
| 2009/0284186 | A1 | 11/2009 | Koch et al. |
| 2011/0149562 | A1 | 6/2011 | Spartano et al. |
| 2013/0334980 | A1 | 12/2013 | Zhou et al. |
| 2015/0102746 | A1 | 4/2015 | Hunt et al. |
| 2015/0308668 | A1 | 10/2015 | Koch et al. |
| 2017/0299130 | A1 | 10/2017 | Li et al. |
| 2018/0224102 | A1 | 8/2018 | Bian |
| 2018/0299109 | A1 | 10/2018 | Koch et al. |
| 2018/0327154 | A1 | 11/2018 | Solan |
| 2019/0082765 | A1 | 3/2019 | Manning et al. |
| 2019/0154215 | A1 | 5/2019 | Li et al. |
| 2020/0236754 | A1* | 7/2020 | Horne ..... H05B 47/165 |
| 2021/0207793 | A1* | 7/2021 | Horne ..... H05B 47/10 |

FOREIGN PATENT DOCUMENTS

| | | | |
|---|---|---|---|
| CN | 201954273 | U | 8/2011 |
| CN | 203202643 | U | 9/2013 |
| CN | 207906920 | U | 9/2018 |
| CN | 208079466 | U | 11/2018 |
| CN | 209587703 | U | 11/2019 |
| CN | 209840028 | U | 12/2019 |
| CN | 210662376 | U | 6/2020 |
| KR | 1020130120421 | A | 11/2013 |

* cited by examiner

LIGHTING APPARATUS HAVING ULTRA-LOW MODE

CROSS-REFERENCE TO RELATED APPLICATIONS

This application claims priority to U.S. Provisional Patent Application No. 63/138,563 filed Jan. 18, 2021, the entire contents of which are incorporated herein by reference.

FIELD

The application relates to a lighting apparatus such as a flashlight, and more specifically, to a flashlight with multiple lighting modes including an ultra-low luminescent mode.

BACKGROUND

Flashlights typically include multiple modes such as spotlight modes, flood light modes, etc. A user generally selects the mode by altering a distance or arrangement between a light source (e.g., bulb, LED, etc.) and an optic (e.g., lens). In some instances, a user may alter the brightness emitted by the light source depending on a desired application.

SUMMARY

In one embodiment, the invention provides a lighting apparatus including a light source operable to emit different levels of brightness, and a user interface configured to be selectively actuated by a user to turn the light source off and on. When the light source is off and the user interface is actuated for a first amount of time, the light source turns on in a first mode in which the light source emits a first level of brightness. When the light source is off and the user interface is actuated for a second amount of time that is different from the first amount of time, the light source turns on in an ultra-low mode in which the light source emits a second level of brightness.

In another embodiment, the invention provides a lighting apparatus including a light source operable in a plurality of modes, a user interface that can be actuated by a user to select a mode of the light source, and an electronic processor coupled to the light source and to the user interface. The electronic processor is configured to receive a first signal from the user interface when the user interface is actuated for a first amount of time, operate the light source in a first mode in response to receiving the first signal, receive a second signal from the user interface when the user interface is actuated for a second amount of time that is different from the second amount of time, and operate the light source in an ultra-low mode in response to receiving the second signal.

In yet another embodiment, the invention provides a method of operating a lighting apparatus that includes a light source, a user interface, and an electronic processor coupled to the light source and the user interface. The method includes actuating the user interface for a first amount of time, in response to actuating the user interface for a first amount of time, operating the light source in a first mode, actuating the user interface for a second amount of time that is different from the second amount of time, and in response to actuating the user interface for the second amount of time, operating the light source in an ultra-low mode.

Other aspects of the disclosure will become apparent by consideration of the detailed description and accompanying drawings.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

DETAILED DESCRIPTION

Figure 1A:
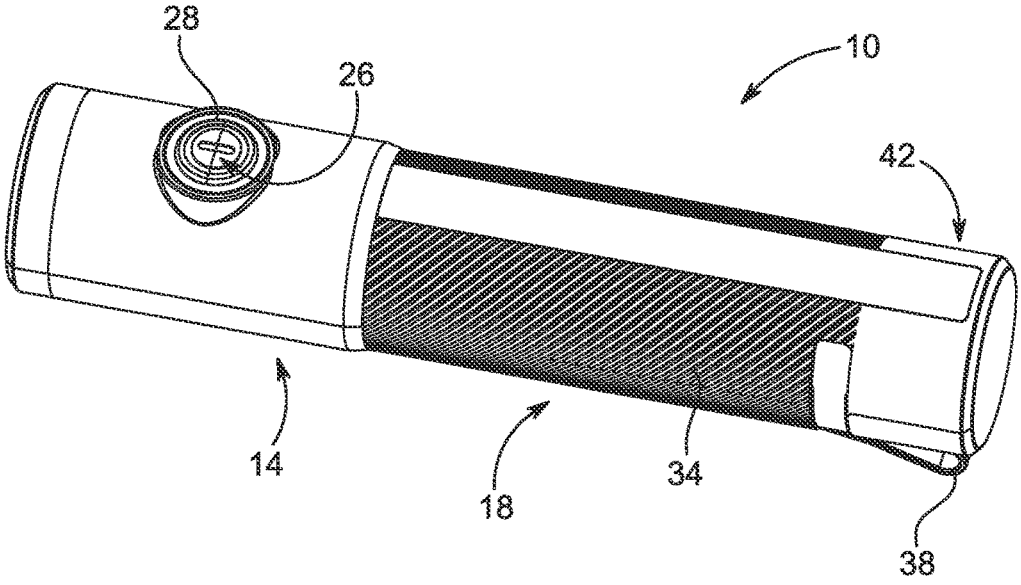
FIG. 1A is a perspective view of a flashlight, according to one embodiment.
Figure 1B:
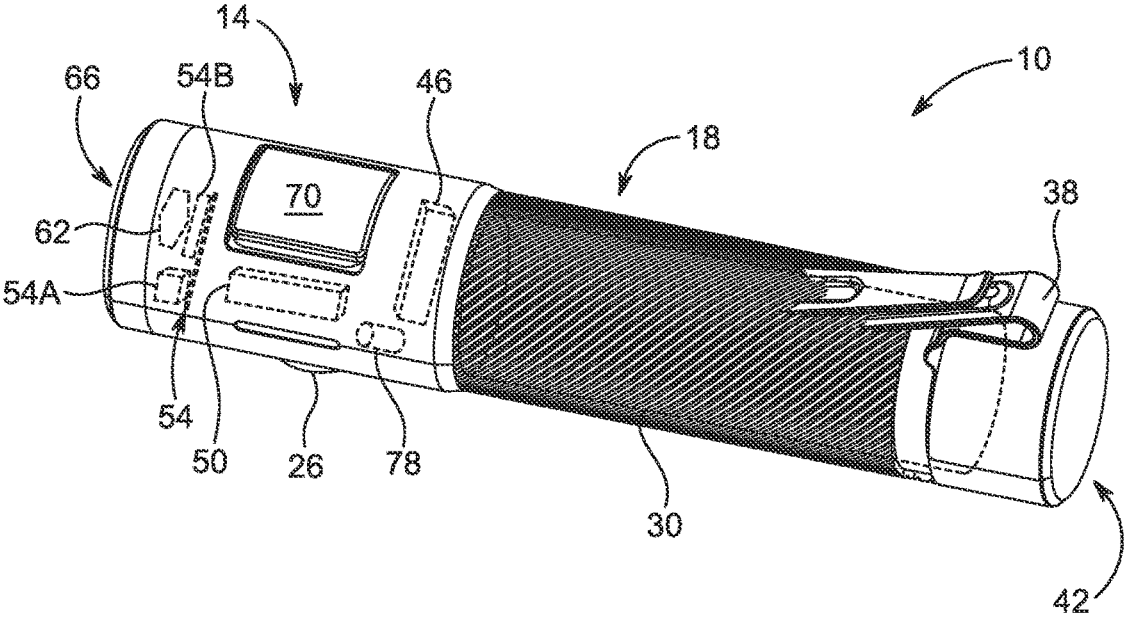
FIG. 1B is another perspective view of the flashlight of FIG. 1 illustrating components inside the flashlight.

FIGS. 1A and 1B illustrate a lighting apparatus, such as a flashlight 10. In other embodiments, the lighting apparatus may be other types of devices, such as a headlamp, a work light, a flood light, an area light, or the like. The illustrated flashlight 10 includes a housing 14 and is operable in multiple modes (e.g., different levels of brightness). The housing 14 includes a handle 18, a light head 22, and a user interface 26. The user interface 26 is operable to turn the flashlight 10 ON and OFF. The user interface 26 is also operable to change an operating mode of the flashlight 10. The illustrated user interface 26 is a pressable pad or button, but other types of selectors, such as a rotatable ring, slider, or the like, are contemplated. The user interface 26 may be encircled by an indicator ring 28, which illuminates to display a charge/battery status (e.g., green for full battery, yellow for partial battery, red for low battery, etc.) of the flashlight 10. As illustrated in FIG. 1A, the user interface 26 is supported on the light head 22 and positioned to be easily pressable by a thumb of a user. In other embodiments, the user interface 26 could alternatively be positioned on the handle 18 or on another part of the housing 14, such as on an end of the flashlight 10 opposite the light head 22.

With continued reference to FIGS. 1A and 1B, the handle 18 houses a battery 30. The battery 30 is concealed in the handle 18 and powers the flashlight 10. The illustrated handle 18 also includes a grip 34, a clip 38, and a tail cap 42. The grip 34 may be defined by, for example, a knurled or otherwise contoured surface. The tail cap 42 is removable from a remainder of the handle 18 to access the battery 30.

In some embodiments, the tail cap 38 is threaded onto the remainder of the handle 18. In other embodiments, the tail cap 42 is integrally formed with the remainder of the handle 18, and access to the battery 30 is provided by removing the light head 22 from the handle 18.

Figure 2:
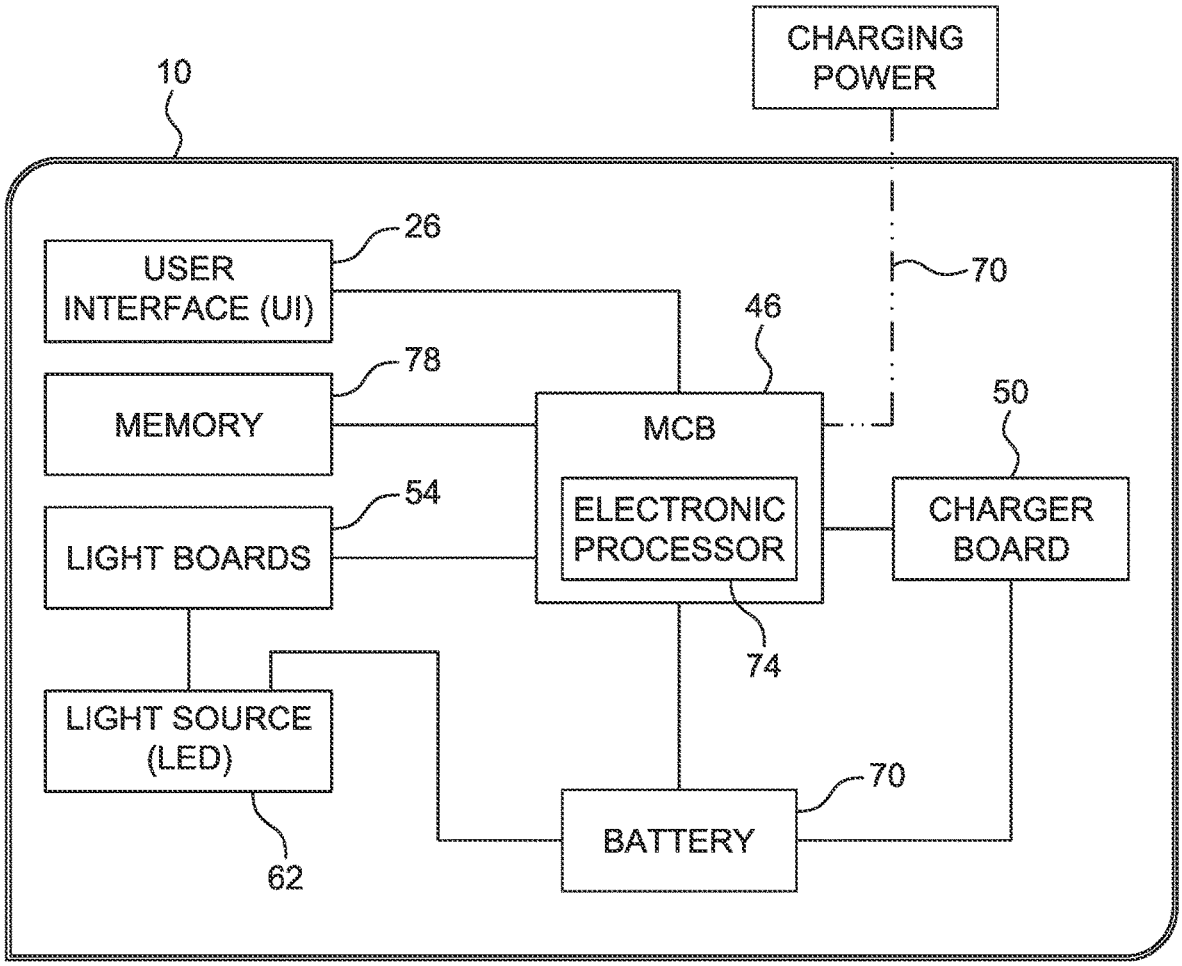
FIG. 2 is a block diagram of the flashlight of FIG. 1, according to an example embodiment.

As illustrated in FIGS. 1B and 2, the light head 22 supports the user interface 26, and houses a main control board or "MCB" 46, a charger board 50, a light board 54, a light source 62, a lens 66, and a charging receptacle 70. In the illustrated embodiment, the light source 62 includes a light emitting diode (LED) connected to the light board 54, which includes a light driver board 54A as well as a light enable board 54B. In some embodiments, the light source 62 may include an array of LEDs. In other embodiments, the light head 22 may include other suitable light sources.

FIG. 2 is an example block diagram of the flashlight 10, which includes an electronic processor 74 that may be supported by the MCB 46, in one embodiment. The electronic processor 74 is configured to implement several control circuits such as a main control circuit, a charging circuit, an LED enabling circuit, and the like. In the illustrated embodiment, the electronic processor 74 is electrically coupled to a variety of components of the flashlight 10 (e.g., the user interface 26, the MCB 46, etc.) and includes electrical and electronic components that provide power, operational control, and protection to the components of the flashlight 10. In some embodiments, the electronic processor 74 includes, among other things, a processing unit (e.g., a microprocessor, a microcontroller, or another suitable programmable device).

The processing unit of the electronic processor 74 may include, among other things, a control unit, an arithmetic logic unit ("ALU"), and registers. In some embodiments, the electronic processor 74 may be implemented as a programmable microprocessor, an application specific integrated circuit ("ASIC"), one or more field programmable gate arrays ("FPGA"), a group of processing components, or with other suitable electronic processing components.

In the illustrated embodiment, the electronic processor 74 includes a memory 78 (for example, a non-transitory, computer-readable medium) that includes one or more devices (for example, RAM, ROM, flash memory, hard disk storage, etc.) for storing data and/or computer code for completing or facilitating the various processes, layers, and modules described herein. The memory 78 may include database components, object code components, script components, or other types of code and information for supporting the various activities and information structures described in the present application. The electronic processor 74 is configured to retrieve data from the memory 78 and execute, among other things, instructions related to the control processes, algorithms, and methods described herein. The electronic processor 74 is also configured to store/write information on/to the memory 78. For example, the memory 78 can store information regarding the last used mode of the flashlight 10 before the flashlight 10 is turned OFF.

In some embodiments, the battery 30 is coupled to and transmits power to the electronic processor 74, the MCB 46, and the light source 62. The battery 30 may include one or more batteries, such as Li-ion batteries or alkaline batteries. The batteries may be removable and/or rechargeable. In other embodiments, the battery 30 may be a dedicated battery. In some examples, the battery 30 includes other power storage devices, such as super-capacitors or ultra-capacitors. In some embodiments, the battery 30 includes combinations of active and passive components (e.g., voltage step-down controllers, voltage converters, rectifiers, filters, etc.).

The battery 30, in one example, is always wired to provide power to the MCB 46 such that even if the flashlight 10 is not being used (i.e., turned OFF), the MCB 46 may still receive power from the battery 30. In similar embodiments, components such as the user interface 26 and the memory 78 receive power from the battery 30 through the MCB 46 and are not independently connected to the battery 30. In other embodiments, the battery 30 may be connected to each component in the flashlight 10 or only some of the components in the flashlight 10.

Figure 3:
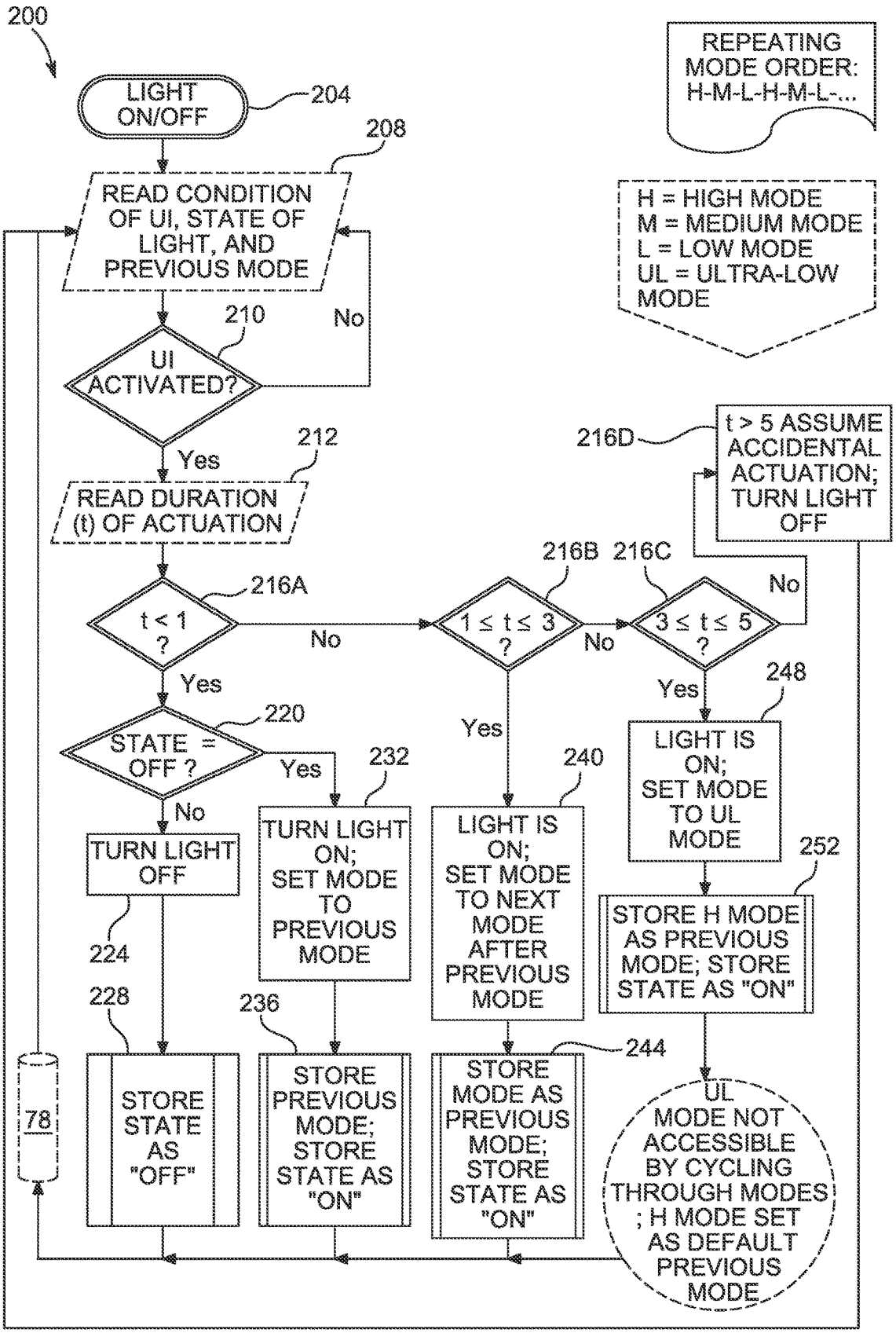
FIG. 3 is a flow chart illustrating a process for selecting a desired operating or output mode of the flashlight of FIG. 1, according to an example embodiment.

With reference to FIGS. 2 and 3, the electronic processor 74 is configured to control a drive current provided by the battery 30 to the light source 62 and the MCB 46 by controlling a pulse width modulation ("PWM") duty cycle that controls when the battery 30 provides the drive current to the light board 54. The light board 54 is configured to enable the light source 62 based on a PWM signal provided to the light board 54. The electronic processor 74 is further configured to receive inputs from the user interface 26 and communicate a command or signal (e.g., PWM signal) to the light board 54 based on the inputs. For example, the electronic processor 74 is configured to receive an input (e.g., input PWM signal) when the user interface 26 is actuated by a user.

In the illustrated embodiment, charging power is transmitted through the charging receptacle 70 and into the MCB 46. The electronic processor 74 may sense the presence of charging power and divert the charging power through the charger board 50 to recharge the battery 30. In other embodiments, charging power may be received directly by the charger board 50. As shown in FIG. 2, the battery 30 is connected back to the MCB 46 such that the MCB 46 is always powered as long as the battery 30 is not fully depleted and not being charged.

The electronic processor 74 may additionally provide a level of battery charge to the memory 78, which may be connected to the MCB 46. In some embodiments, the battery charge level is stored on the MCB 46. Regardless of which component reads and/or stores the battery charge level, the electronic processor 74 is further configured to illuminate the indicator ring 28 with different colors based on how much charge remains/how much charge has been depleted. For example, if the battery 30 is at 100% charge capacity, the indicator ring 28 may be illuminated in green. In a similar manner, if the battery 30 is nearly 100% depleted, the indicator ring 28 may be illuminated in red, or even in a flashing red pattern. In some embodiments, the indicator ring 28 may also be illuminated to indicate that the battery 30 is being recharged. Although the indicator ring 28 in the illustrated embodiment encircles the user interface 26, the indicator ring 28 could be located on another part of the flashlight 10 or omitted entirely.

In the illustrated embodiment, the user interface 26 includes a contact that receives power through the MCB 46 and is configured to provide a status of the user interface 26 back to the electronic processor 74, which receives a signal from the user interface 26 based on the status. The processor 74, in turn, interprets the status and signal of the user interface 26 and sends a PWM signal in accordance with the flowchart 200 shown in FIG. 3. Stated another way, the electronic processor 74 sets an operational mode of light source 62 based on detected user actuation of the user interface 26. In addition to detecting whether the user interface 26 has been actuated, the electronic processor 74 is also configured to sense a duration (e.g., time (t) measured in seconds) of actuation. As described in greater detail below, the operational mode of the flashlight 10 and/or the light source 62 is operable in response to the user interface 26 being actuated for different amounts of time.

The operational modes of the flashlight 10, and thereby the light source 62, include an OFF mode, a high output luminescent ON mode ("HIGH mode"), a medium output luminescent ON mode ("MEDIUM mode"), a low output luminescent ON mode ("LOW mode"), and an ultra-low output luminescent ON mode ("ULTRA-LOW mode"). In other embodiments, the flashlight 10 may include fewer or more modes. Additionally or alternatively, the flashlight 10 may include different types of modes, such as a flashing mode. In the OFF mode, the light source 62 does not emit light because no PWM signal is sent by the electronic processor 74. In this mode, the light source 62 may still be electrically connected to the battery 30.

In HIGH mode, the light board 54 receives a PWM signal and the light source 62 emits light at a first brightness. In the illustrated embodiment, the first brightness may be in the range of 600 to 1100 Lumens. The first brightness may be, for example, 100% of a potential output of the light source 62. In MEDIUM mode, the light board 54 receives a PWM signal and the light source 62 emits light at a second brightness. The second brightness is less than the first brightness. In the illustrated embodiment, the second brightness may be in the range of 150 to 650 Lumens. The second brightness may be, for example, 75% of the potential output of the light source 62. In LOW mode, the light board 54 receives a PWM signal and the light source 62 emits light at a third brightness. The third brightness is less than the first brightness and the second brightness. In the illustrated embodiment, the third brightness may be in the range of 50 to 150 Lumens. The third brightness may be, for example, 50% of the potential output of the light source 62. In ULTRA-LOW mode, the light board 54 receives a PWM signal and the light source 62 emits light at a fourth brightness. The fourth brightness is less than the first brightness and the second brightness. In some embodiments, the fourth brightness is also less than the third brightness. In other embodiments, the fourth brightness may be equal or similar to the third brightness. In such embodiments, the ULTRA-LOW mode may differ from the LOW mode based on how the flashlight 10 is turned on, as explained below. In the illustrated embodiment, the fourth brightness may be in the range of 25 to 75 Lumens. The fourth brightness may be, for example, 25% of the potential output of the light source 62. Alternatively, the fourth brightness may be 50% of the potential output of the light source 62. Although different brightness levels are discussed with respect to the illustrated embodiment, different ranges of brightness may be implemented. For example, in ULTRA-LOW mode, the brightness of the light source 62 may be as low as 10 Lumens.

During operation of the flashlight 10, the expectation of the user is that each mode emits a different brightness and that the brightness suitable for a desired application or scenario may be selected. For example, the ULTRA-LOW mode may be utilized when working around highly reflective surface (e.g., sheet metal, glass, etc.) to reduce reflected light, and/or while working in confined spaces. The multiple modes of the flashlight 10 allow the user to advantageously switch between outputs without requiring the user to switch flashlight 10. Stated another way, the flashlight 10 is configured to accomplish the functions of a variety of flashlights such that the user can rely on a single flashlight rather than needing multiple flashlights depending on the desired application (e.g., a first flashlight with high lumen output for area lighting, a second flashlight with medium lumen output for recreation, etc.).

With specific reference to the flowchart of FIG. 3, an example process 200 for controlling the output of the light source 62 and/or selecting the illumination modes the flashlight 10 will now be described in greater detail. The process 200, which is implemented by the electronic processor 74 in one example, may include additional steps or functions not specifically discussed herein (e.g., reading a state-of-charge to confirm the flashlight has sufficient power, reading a temperature to confirm to flashlight can be operated safely, etc.).

At process block 204, the flashlight 10 is turned ON/OFF, such as by a user actuating the user interface 26. At process block 208, a condition of the user interface 26 (e.g., is the user interface 26 depressed/being pressed?), a state of the light source 62 (i.e., ON/OFF), and the previous operating mode are each determined. The condition, state, and previous operating mode may each be stored to the memory 78 and accessed by the electronic processor 74 simultaneously. As such, the pervious operating mode may also be referred to as a stored mode. The memory 78 may further store the code/data needed to implement the process 200. In some embodiment, the data is stored directly on the MCB 46.

At process block 210, the electronic processor 74 determines whether the user interface 26 is being actuated. If the user interface 26 is not being actuated, then the process 200 loops back to reading the conditions at block 208. If the user interface 26 is being actuated, the process 200 proceeds to block 212, where the electronic processor 74 reads a length of time that the user interface 26 is being actuated. The actuation duration, abbreviated in FIG. 3 as "t", is measured in seconds by the electronic processor 74.

In some embodiments, the user interface 26 is depressible for four different lengths to time (t) and is configured to provide a signal to the electronic processor based on the different lengths of time (t). In one example, the user interface 26 may be actuated a first length of time to switch the light source 62 between ON and OFF states. In the illustrated embodiment, the first length of time is less than 1 second. The first length of time may also be considered a momentary actuation. The user interface 26 may be actuated a second length of time that is longer than the first length of time to switch the light source 62 between HIGH, MEDIUM, and LOW modes. In the illustrated embodiment, the second length of time is 1 to 3 seconds. The user interface 26 may be actuated a third length of time that is longer than the second length of time to switch the light source 62 from the OFF state to the ULTRA-LOW mode. In the illustrated embodiment, the third length of time is 3 to 5 seconds. If the user interface 26 is depressed for a fourth length of time that is longer than the third length of time, the light source 62 may remain OFF. In the illustrated embodiment, the fourth length of time is longer than 5 seconds.

In the illustrated embodiment, once the time of actuation is determined in block 212, the process 200 proceeds to blocks 216A, 216B, 216C, 216D where the processor 74 associates a command based on the duration or time of actuation. At process blocks 216A-D, the electronic processor 74 determines the time of actuation by receiving a signal from the user interface 26. If the time of actuation is within the first length of time (e.g., is less than 1 second), the process 200 proceeds to block 220 where the electronic processor 74 retrieves the state of the light source 62. If the state is ON (i.e., light source 62 is ON), regardless of operating mode, then the electronic processor 74 turns the light source 62 OFF (block 224) and stores the state of the light source 62 as OFF (block 228) to the memory 78. While a representative example of the memory 78 is illustrated in FIG. 3 as being after blocks 216A-D, it should be stated that the memory 78 may be written to or accessed at any time during the process 200.

If the state is OFF (i.e., light source 62 is OFF), then the electronic processor 74 turns the light source 62 ON and sets the operating mode to the previous operating mode, as shown at block 232. In some embodiments, the HIGH mode is automatically set as the default operating mode such that the electronic processor 74 will set the light source 62 to the HIGH mode if a previous operating mode cannot be determined. In other embodiments, the MEDIUM mode or LOW mode may alternatively be set as a default operating mode. At process block 236, the electronic processor 74 stores the operating mode as the previous mode and stores the state of the light source 62 as ON. For example, if the previous mode of the flashlight 10 is the MEDIUM mode, then the electronic processor 74 will turn the flashlight 10 ON in the MEDIUM mode at block 232 and store the MEDIUM mode as the previous mode at block 236. Once the mode is stored at block 236, the process 200 loops back to block 208 to continuously read the condition, state, and operating mode.

Referring back to block 212, if the time of actuation read in block 216A is greater than the first length of time (e.g., greater than 1 second), the process 200 proceeds to block 216B. If the time of actuation read in block 216B is within the second length of time (e.g., is greater than or equal to 1 second, but less than or equal to 3 seconds), the process 200 proceeds to block 240 in which the light source 62 will be ON and the electronic processor 74 will cycle the mode of the flashlight 10 to the next standard mode (i.e., HIGH, MEDIUM, or LOW) in the order of standard operating modes. In the illustrated embodiment, the order of standard operating modes may be cycled through in a re-occurring order from HIGH to MEDIUM to LOW to HIGH to MEDIUM to LOW, etc. In other embodiments, the order of standard modes may be reversed. For example, if the previous mode is stored as the LOW mode, then a user may cycle the flashlight 10 to the HIGH mode by depressing the user interface 26 and releasing the interface 26 after 2 seconds. Although the example process 200 allows the electronic processor 74 to turn the light source 62 ON when the time of actuation is less than 1 second (block 232), other processes for the flashlight 10 may allow the electronic processor 74 to turn the light source 62 ON when the time of actuation is greater than 1 second.

At process block 244, the electronic processor 74 stores the operating mode as the previous mode by writing over the stored previous mode and further stores the state of the light source 62 as ON. Once the mode is stored at block 244, the process 200 loops back to block 208 to continuously read the condition, state, and operating mode.

Referring back to block 212, if the time of actuation read in block 216A is greater than the second length of time (e.g., greater than 3 seconds), then the process 200 proceeds to block 216C. If the time of actuation read in block 216C is within the third length of time (e.g., is greater than 3 seconds but less than or equal to 5 seconds), the process 200 proceeds to block 248 in which the light source 62 will be ON and the electronic processor 74 will set the operating mode to the ULTRA-LOW mode based on a signal received from the user interface 26, regardless of which mode is stored as the previous mode. The light source 62 may enter the ULTRA-LOW mode by actuating the user interface 26 within the third length of time when the light source 62 is OFF or ON.

At process block 252, the electronic processor 74 stores the default HIGH mode as the previous mode and stores the state of the light source 62 as ON. The default HIGH mode is set at block 252 to prevent the flashlight 10 from being turned ON directly in the ULTRA-LOW mode. Stated another way, if the light source 62 is turned OFF from the ULTRA-LOW mode and a user then actuates the user interface 26 to turn the flashlight 10 back ON, the light source 62 will turn back ON in the default HIGH mode even though the flashlight 10 was last operated in the ULTRA-LOW mode. Once the mode is stored/reset to default at block 252, the process 200 loops back to block 208 to continuously read the condition, state, and operating mode.

Referring back to block 212, if the time of actuation read in block 216A is greater than the third length of time (e.g., greater than 5 seconds), then the process 200 proceeds to block 216D. If the process 200 proceeds to block 216D, then the user interface 26 has been depressed within the fourth length of time. The electronic processor 74 is configured to interpret an actuation within the fourth length of time (e.g., for more than 5 seconds) as an accidental actuation of the user 26 and is further configured to maintain the light source 62 in an OFF state. The electronic processer 74 interprets the length of actuation based on corresponding signals sent by the user interface 26.

In one example scenario of accidental actuation, a user may be storing the flashlight 10 in a confined space, such as their pocket, and briefly bump the user interface 26 during an activity to accidentally turn the light source 62 ON. The user may accidently depress the user interface 26 numerous times during such activity. Once the user changes to a different activity with less movement, such a driving, the flashlight 10 may be set in a different position in the user's pocket in which the user interface 26 is continually held down. If the light source 62 is ON in the user's pocket and the user interface 26 is continuously pressed for greater than 5 seconds, then the electronic processor 74 assumes accidental or unintentional actuation of the user interface 26 and turns the light source 62 OFF or maintains the light source 62 in the OFF state. Once the light source 62 is turned OFF at block 216D, the process 200 loops back to block 208 to continuously read the condition, state, and operating mode. In one example, if the user interface 26 is continually pressed over a long period of time such that the process 200 runs through the same loop repeatedly without change, the electronic processor 74 may delay a computing speed or refresh rate of the process 200 in order to conserve the charge of the battery 30.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described. For example, although the HIGH, MEDIUM, LOW, and ULTRA-LOW modes are each described herein as each having different relative ranges of luminescent outputs, the difference between relative modes could also be defined by/associated with a percentage of a maximum luminescent output for a flashlight.

Various features and advantages of the invention are set forth in the following claims.

What is claimed is:

1. A lighting apparatus comprising:

a light source operable to emit different levels of brightness; and a user interface configured to be selectively actuated by a user to turn the light source off and on;

wherein when the light source is off and the user interface is actuated for a first amount of time within a first range, the light source turns on in a first mode in which the light source emits a first level of brightness, the first mode being one of a high mode, a medium mode, and a low mode, wherein when the light source is on and the user interface is actuated for a second amount of time within a second range that is different than the first range, the light source cycles through the high mode, the medium mode, and the low mode, wherein when the light source is on in each of the high mode, the medium mode, and the low mode and the user interface is actuated for a third amount of time within the first range, the light source turns off, and wherein when the user interface is actuated for a fourth amount of time within a third range that is different from the first and second ranges, the light source turns on in an ultra-low mode in which the light source emits a second level of brightness.

2. The lighting apparatus of claim 1, wherein when the light source is on and the user interface is actuated for a fifth amount of time within a fourth range that is different from the first, second, and third ranges, the light source turns off.

3. The lighting apparatus of claim 2, wherein the first range and the second range are less than the third range, and wherein the first range, the second range, and the third range are less than the fourth range.

4. The lighting apparatus of claim 3, wherein second range lies within a range of one second to three seconds, wherein the third range lies within a range of three seconds to five seconds, and wherein the fourth range is greater than five seconds.

5. The lighting apparatus of claim 1, wherein the lighting apparatus is a flashlight including a housing having a light head and a handle, and a battery positioned within the housing.

6. A lighting apparatus comprising:

a light source operable in a plurality of modes;

a user interface that can be actuated by a user to select a mode of the light source; and an electronic processor coupled to the light source and to the user interface, the electronic processor configured to:

receive a first signal from the user interface when the user interface is actuated for a first amount of time within a first range, turn the light source on or off in response to receiving the first signal, receive a second signal from the user interface when the user interface is actuated for a second amount of time within a second range that is different than the first range, cycle the light source between a high mode, a medium mode, and a low mode in response to receiving the second signal, receive a third signal from the user interface when the user interface is actuated for a third amount of time within a third range that is different from the first and second ranges, and operate the light source in an ultra-low mode in response to receiving the third signal.

7. The lighting apparatus of claim 6, wherein the light source is configured to output 100% of a maximum amount of brightness of the light source while in the high mode, and wherein light source is configured to output 25% or less of the maximum amount of brightness of the light source while in the ultra-low mode.

8. The lighting apparatus of claim 6, wherein the light source is operable to emit as low as 10 lumens while in the ultra-low mode.

9. The lighting apparatus of claim 6, wherein the first range is less than the second range, and wherein the second range is less than the third range.

10. The lighting apparatus of claim 6, wherein the electronic processor is further configured to:

store the first mode as a stored mode when the light source is turned off, and operate the light source in the stored mode in response to receiving the first signal.

11. A method of operating a lighting apparatus, the lighting apparatus including a light source, a user interface, and an electronic processor coupled to the light source and the user interface, the method comprising:

actuating the user interface for a first amount of time;

in response to actuating the user interface for the first amount of time within a first range, turning the light source on or off;

actuating the user interface for a second amount of time within a second range that is different from the first range;

in response to actuating the user interface for the second amount of time, cycling the light source between a high mode, a medium mode, and a low mode actuating the user interface for a third amount of time within a third range that is different from the first and second ranges; and in response to actuating the user interface for the third amount of time, operating the light source in an ultra-low mode.

* * * * *